United States Patent [19]

List

[11] 4,094,129

[45] June 13, 1978

[54] COUNTING AND FILLING APPARATUS FOR TABLETS, DRAGEES OR SIMILAR ELEMENTS

[76] Inventor: Hans List, Laustrasse 51, 7 Stuttgart 70, Germany

[21] Appl. No.: 820,788

[22] Filed: Aug. 1, 1977

[51] Int. Cl.[2] ..... B65B 57/10; B65B 57/20

[52] U.S. Cl. ..... 53/54; 53/59 R; 53/78; 198/418; 221/9; 221/253

[58] Field of Search ..... 53/54, 59 R, 78; 198/396, 418; 221/9, 253, 233

[56] References Cited

U.S. PATENT DOCUMENTS

| | | | |
|---|---|---|---|
| 3,354,607 | 11/1967 | Lakso | 53/78 |
| 3,925,960 | 12/1975 | Saari et al. | 53/78 |

*Primary Examiner*—Travis S. McGehee
*Attorney, Agent, or Firm*—Michael J. Striker

[57] ABSTRACT

A counting and filling apparatus for tablets, dragees, or similar elements comprises a plurality of counting bars arranged parallel and closely adjacent each other and each formed with a plurality of cutouts therethrough, spaced from each other in the longitudinal direction of the bars. The bars are connected in the region of opposite ends by chains or the like to form an endless receiving and transporting unit, which is guided over front and rear reversing rolls, at least one of which is driven so that the unit moves along an endless path having an upper and a lower run. The elements are filled in the region of the upper run into the cutouts of the counting bars and prevented from falling out of the same by a boundary means extending along the upper run and the front reversing roll. Scanning means are provided to check the presence or absence of elements in each of the cutouts of the bars as the latter pass the scanning means, and the scanning means cooperate with ejector means for ejecting all elements from the cutout of the respective bar if the scanning means senses the absence of an element in at least one of the cutouts of the bar, or the scanning means cooperate with additional filling means to fill any empty cutout in the respective bar.

51 Claims, 16 Drawing Figures

Fig. 4
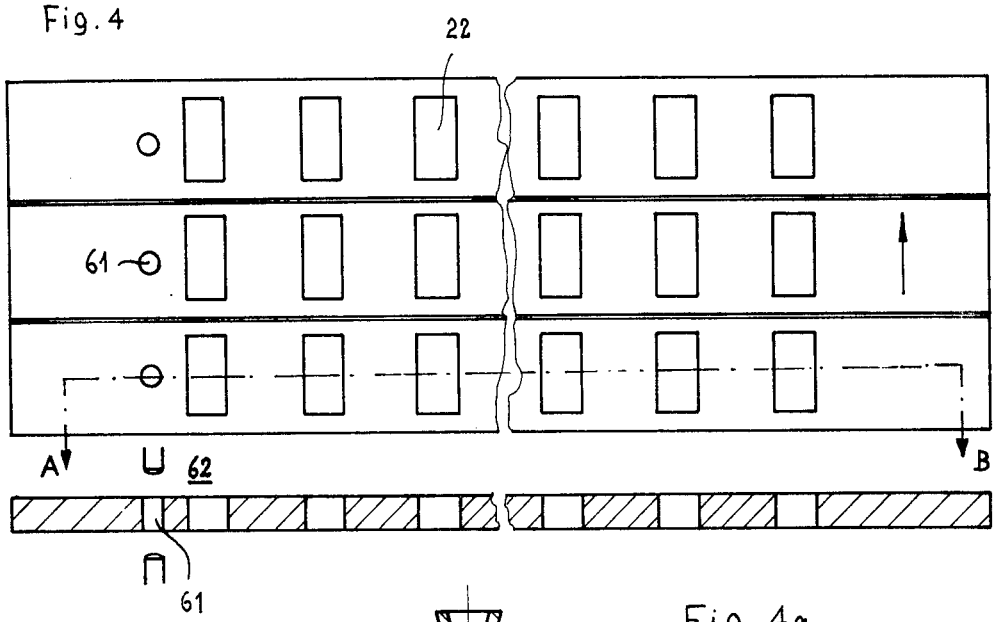
Fig. 4a
Fig. 7
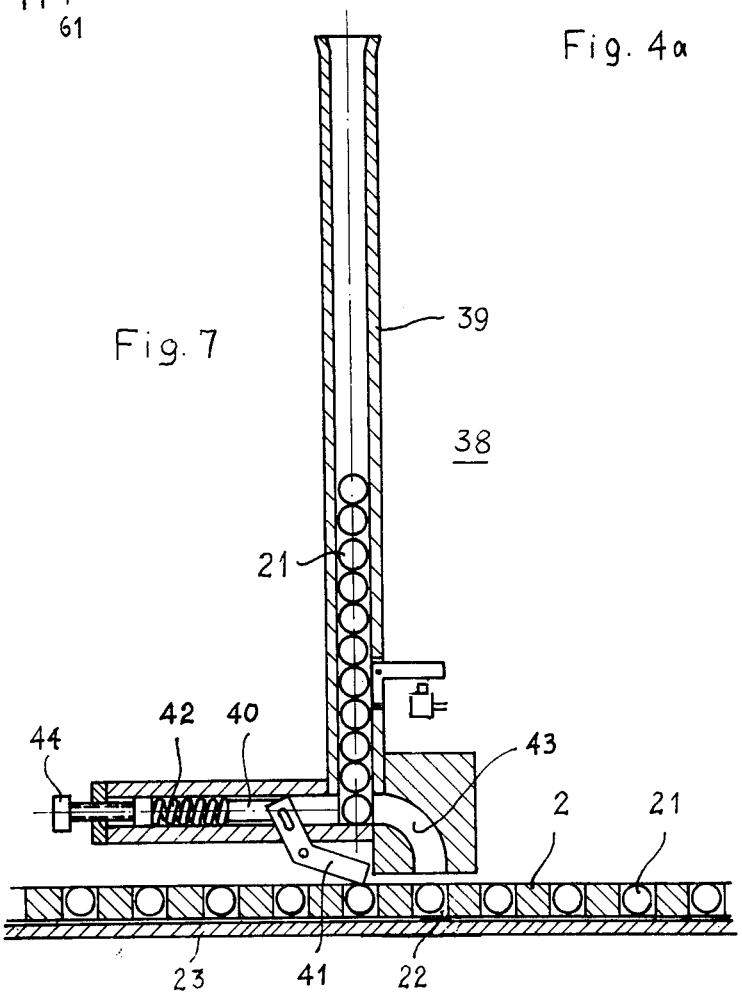

COUNTING AND FILLING APPARATUS FOR TABLETS, DRAGEES OR SIMILAR ELEMENTS

BACKGROUND OF THE INVENTION

The present invention relates to a counting and filling apparatus for tablets, dragees or similar elements comprising a plurality of counting bars arranged parallel and closely adjacent each other and each formed with a plurality of cutouts, spaced from each other in the longitudinal direction of the bars, for receiving the elements. The bars are connected in the region of opposite ends by carrier elements to form with the latter an endless receiving and transporting unit.

In a known machine of the aforementioned kind the endless receiving and transporting unit extends about three drive or reversing rolls, which are arranged at the corners of a triangle so that a relatively flat ascending section is followed by a steeply descending section, which in turn is followed by a substantially horizontally extending section.

The counting bars are releasably connected to the carrier elements, which are preferably formed by roller chains, and the cutouts formed in the counting bars are constituted by blind bores. An automatic ejection of the elements from counting bars in which not all cutouts are filled with elements by ejector means is in this construction not possible, so that an operator is necessary, to observe, during the passage of the counting bars through the steeply descending section, whether all the cutouts in the bars are properly filled or not. In order to properly permit such a control by the operator, it is necessary that the operator may properly survey the counting bars which at any moment are located at the steeply descending section of the unit. Such a survey will be possible only if the steeply descending section is relatively long. This in turn will require a large overall height of the apparatus. In known machines of this kind the upper edge of the hopper from which the elements are filled into the counting bars is therefore located about two meters, of even higher, above the floor on which the apparatus is mounted. This, in turn, will preclude manual filling of the hopper, and requires additional lifting means to lift the elements for discharging the same into the hopper.

It is therefore evident that the overall cost of such an apparatus, as well as the necessary space for erecting the same, is quite considerable. In addition, the known machines of the aforementioned kind require, as mentioned before, an operator for checking the proper filling of the cavities or cutouts in the counting bars and, in addition, if the cavities in the counting bars are not properly filled, the apparatus has to be stopped, so that the respective counting bar can either be completely emptied or any empty cavities filled by the operator with elements. Such a stopping of the machines evidently precludes a fully automatic operation of the same. In addition, the output of the apparatus is evidently considerably reduced.

Furthermore, since in apparatus of this kind known in the art the angle of inclination of the various sections of the moving receiving and transporting unit cannot be changed, there arise quite often difficulties if the cutouts in the counting bars are, as usually desired, dimensioned for the reception of elements which, within limits, have different dimensions.

These difficulties reside in that, in the event smaller elements are filled into cavities of larger dimensions provided in the counting bars, empty spaces will remain in the filled cutout, into which additional elements may settle, projecting beyond the upper surfaces of the counting bars. To eliminate such elements a stripping brush or similar means is required. Such filling elements, which are stripped from the counting bars, glide then downwardly over the whole length of the relatively flat ascending section into the filling region of the unit, whereby these elements often break. If the surplus elements are not stripped properly, they move beneath the rotating stripping brush, to be either crushed by the same or to be thrown outwardly in the region of the steeply descending section.

Finally it happens quite often, especially during counting and filling of dragees, that dragees are present which are too thick or dragees to which particles of broken dragees cling. Such dragees may be wedged in the blind cavities of the counting bars, so that they may not fall by gravity out of the latter, to continuously move with the unit, thus causing faulty counting.

SUMMARY OF THE INVENTION

It is an object of the present invention to provide a counting and filling apparatus of the aforementioned kind which is more compact than such apparatus known in the art and which can be manufactured at reasonable cost.

It is an additional object of the present invention to provide an apparatus of the aforementioned kind which can be operated in a fully automatic manner.

It is yet an object of the present invention to provide an apparatus of the aforementioned kind which can be easily adapted for use with elements of sligthly different dimensions and in which the danger of breaking these elements or wedging of the elements in the cutouts of the counting bars is substantially eliminated.

With these and other objects in view, which will become apparent as the description proceeds, the counting and filling apparatus according to the present invention for tablets, dragees and similar elements mainly comprises a plurality of elongated counting bars, each provided with a plurality of cutouts therethrough spaced from each other in the longitudinal direction of each bar, carrier elements carrying the bars substantially normal to the carrier elements closely adjacent and parallel to each other and forming with the bars an endless receiving and transporting unit, front and rear reversing means over which the endless unit is guided to form between the reversing means substantially planar upper and lower runs, means to move the unit in an endless path about the reversing means, means for filling the cutouts in the bars located in the upper run with the elements, scanning means downstream of the filling means for scanning the presence or absence of elements in each of the cutouts of each counting bar, and means downstream of the scanning means and controlled by the latter for ejecting all elements from the respective bar, if the scanning means scans the absence of an element from at least one cutout in the respective bar, or additional filling means downstream of the scanning means for filling the cutouts in the respective bar which have been sensed as being empty by the scanning means. The apparatus includes further boundary means directly below the counting bars travelling along the upper run for preventing elements in the cutouts to fall out of the latter, and this boundary means may be formed with openings therethrough if ejector means are provided for the passage of portions of the ejector means through these openings.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 4–6 illustrate various modification of the arrangement of the cutouts in the counting bars;

FIG. 4*a* is a cross-section taken along the line A–B of FIG. 4;

FIG. 7 is a longitudinal cross-section through additional filling;

DESCRIPTION OF THE PREFERRED EMBODIMENTS

Figure 1:
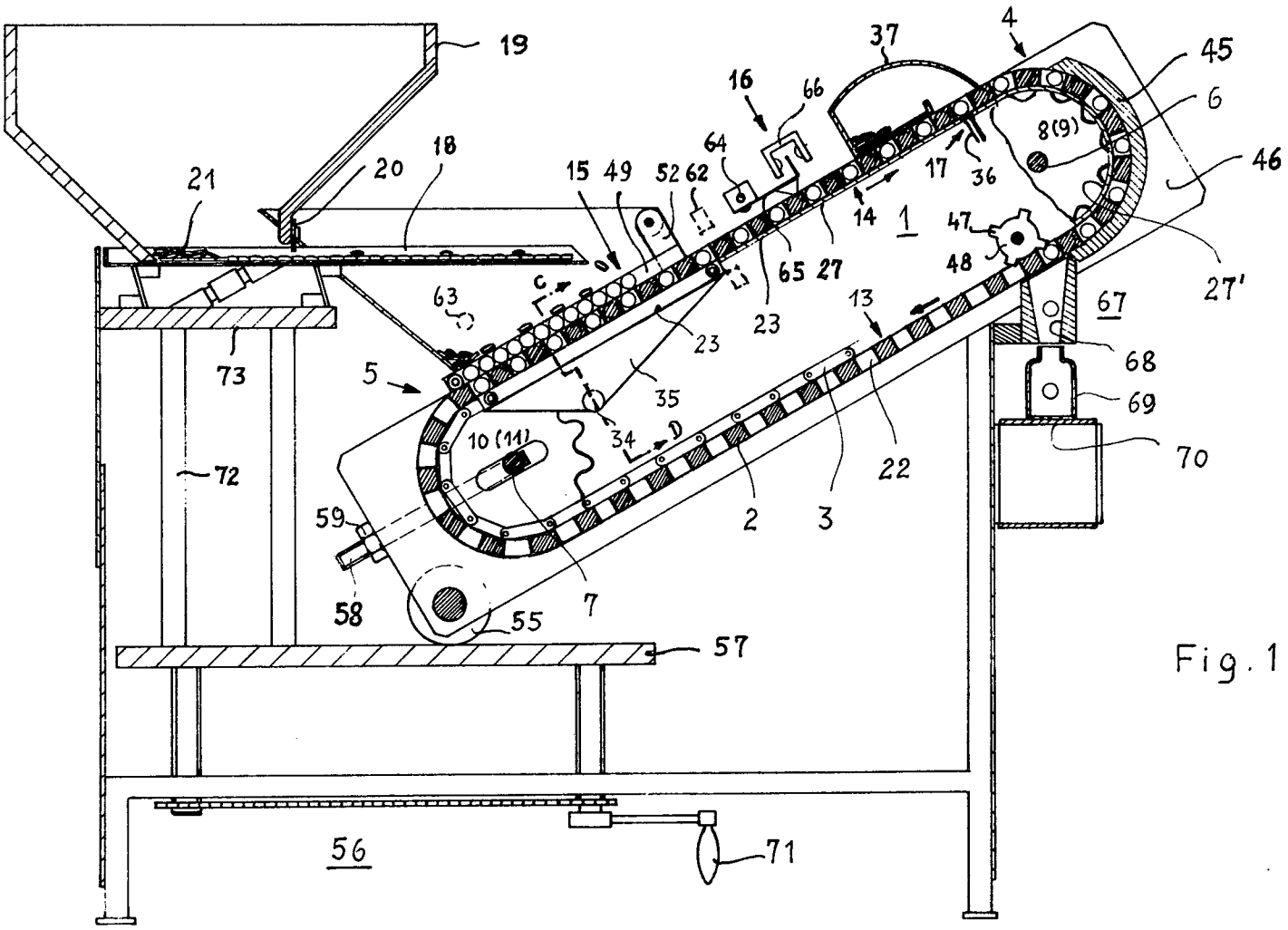
FIG. 1 is a partially sectioned side view of the counting and filling apparatus according to the present invention.
Figure 2:
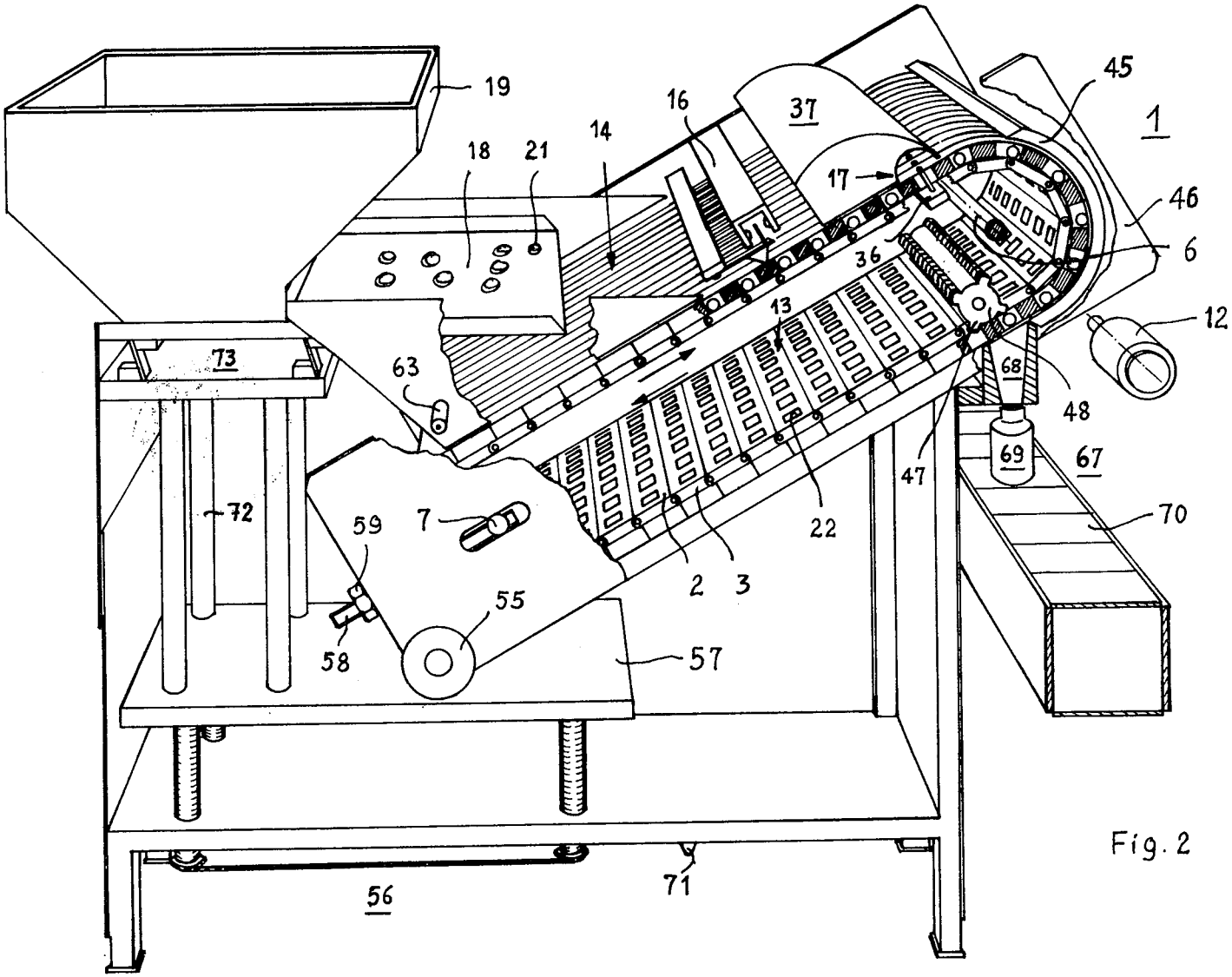
FIG. 2 is a perspective view of the counting and filling apparatus with certain elements thereof removed.

Referring now to the drawing, and more specifically to FIGS. 1 and 2 of the same, it will be seen that the apparatus according to the present invention comprises an endless receiving and transporting unit 1, including a plurality of elongated counting bars 2, arranged with side faces thereof substantially abutting against each other and releasably connected at opposite ends to two carrier elements 3, preferably in the form of chains, which extend spaced from and parallel to each other normal to the longitudinal direction of the bars. The receiving and transporting unit 1 is guided about a front reversing means 4 and a rear reversing means 5, which comprise a shaft 6, respectively 7, and a pair of sprocket wheels 8 and 9, connected to the shaft 6 for rotation therewith and an additional pair of sprocket wheels 10 and 11 connected to the shaft 7 for rotation therewith. One or both of the shafts 6 or 7 may be rotated by a stepless adjustable drive motor, eventually with a speed reducing drive arranged between the motor and the shaft. A drive motor 12 is shown in FIG. 2, which cooperates with the shaft 6.

The unit 1 has between the two reversing means 4 and 5 a lower run 13 and an upper run 14, respectively extending in two parallel planes. Along the upper run 14 there is arranged a forming grate 15, scanning means 16, following the direction of movement of the unit as indicated by the arrow in FIG. 1 the forming grate, and ejector means controlled by the scanning means 16 and following the latter in the aforementioned direction. The forming grate 15 is supplied with elements from a hopper 19 over a feed channel 18. The hopper 19 has an outlet opening above the feed channel 18, which is provided with a height adjustable slide plate 20, so as to change the cross section of the outlet opening.

Figure 3:
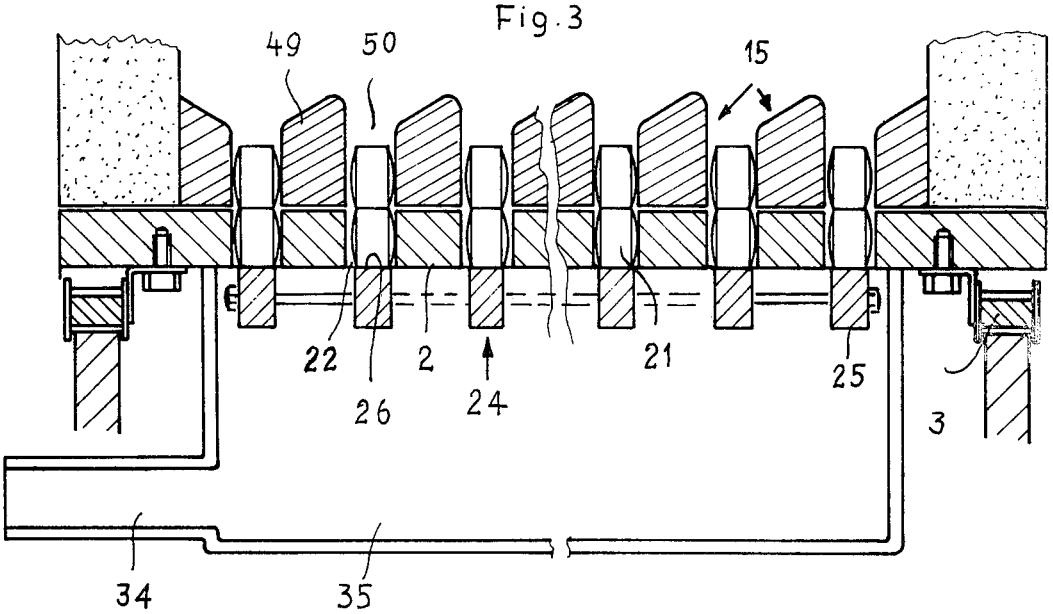
FIG. 3 is a cross-section taken along the line C–D of FIG. 1.
Figure 11:
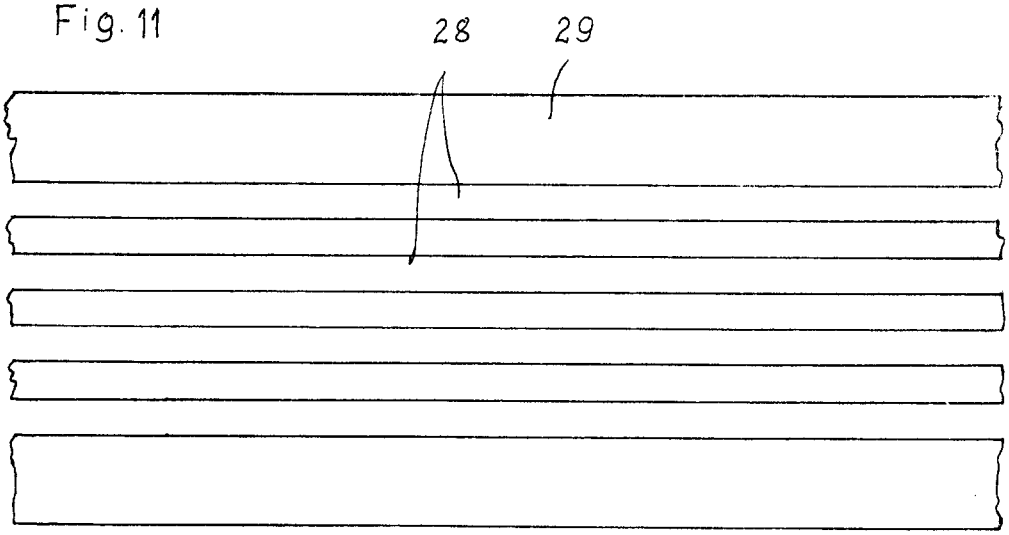
FIG. 11 is a top view or another modification of the boundary means which is constituted by a slotted sheet metal.
Figure 13:
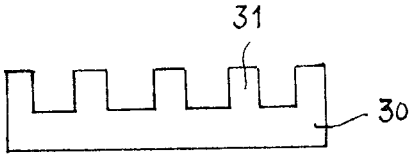
FIG. 13 is an end view of boundary means constituted by a grate constructed as a profiled body.

The counting bars 2 are provided, as best shown in FIGS. 3–6, with a plurality of cutouts 22 for the reception of the elements 21. These cutouts extend completely through the counting bars and are arranged uniformly spaced from each other in the longitudinal direction of the bars aligned with each other in successive bars in this direction. Boundary means 23 are provided directly below the upper run 14 of the unit 1, to prevent the elements 21 from falling out of the cutouts 22. These boundary means may at least in part be constituted by a grate 24, as shown in FIG. 3. Such a grate may for instance comprise a plurality of bars 25 extending normal to the counting bars 2, aligned with the cutouts 22 formed therein, and having upper faces 26 which are preferably slightly smaller than the width of the cutouts 22 in the counting bars 2. The boundary means 23 may also comprise a combination of a grate 24′ and a masking sheet metal 27 following the grate, which is extended into the region of the front reversing means 4 and being formed in the region of the latter as a semi-cylindrical inner casing 27′, as shown in FIG. 1. The grate of the boundary means may also be constituted by a casing 29 of sheet metal, or similar suitable material, which is provided with longitudinal slots 28, as shown in FIG. 11, or, as shown in FIG. 13, the grate of the boundary means may be constituted by a profiled body 30 provided with ribs 31 spaced in transverse direction from each other.

Figure 14:
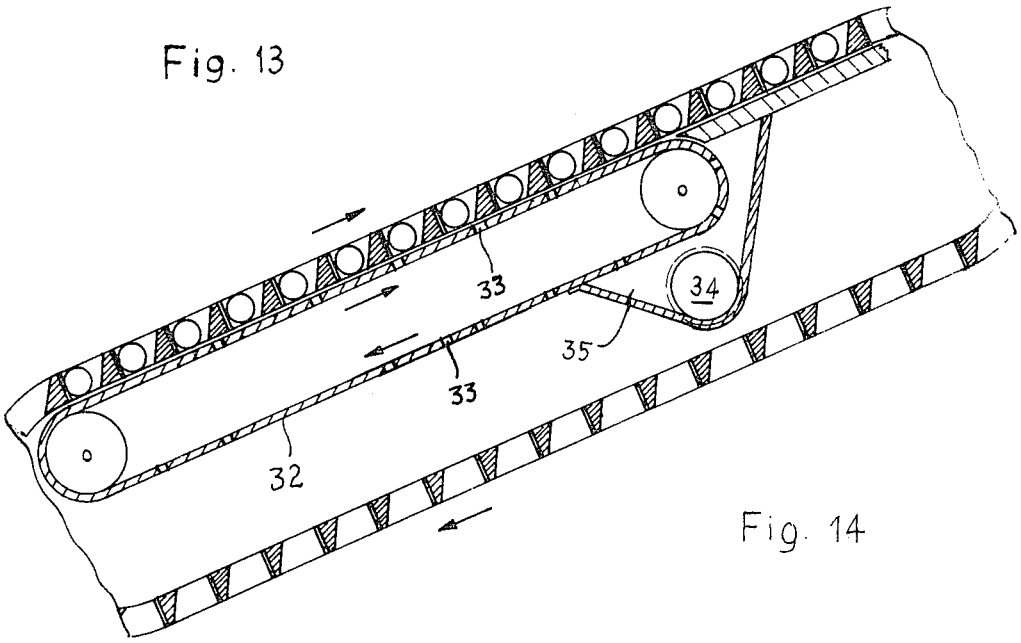
FIG. 14 is a partly sectioned side view in which the boundary means is in form of an endless movable band.
Figure 15:
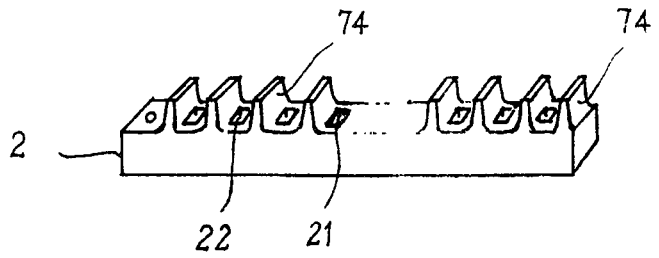
FIG. 15 is a perspective view of a counting bar provided with barriers between the cutouts.

Finally, the boundary means may be constituted at least in part by an endless movable band 32, which is preferably provided with perforations 33 therethrough, as shown in FIG. 14.

In order to remove dust or particles of broken elements from the boundary means 23, a chamber 35 is coordinated with the latter, as best shown in FIGS. 1, 3 and 14. The chamber 35 is provided with an outlet opening 34 to which suction means, not shown in the drawing, are to be connected. If the boundary means are constituted by a movable endless band, then a stripping brush or similar device may be provided for removing of dust or element particles from the boundary means.

Figure 9:
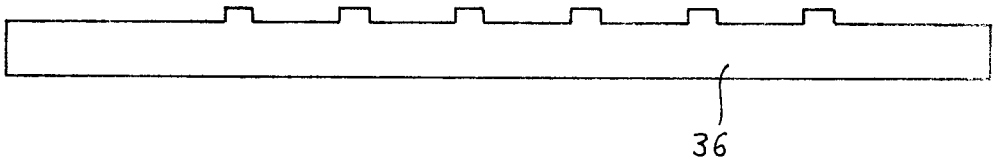
FIG. 9 is a front view of part of the ejector means.
Figure 10:
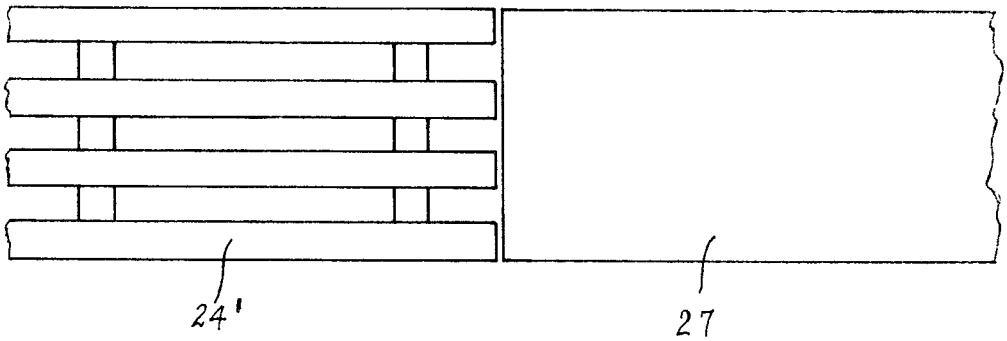
FIG. 10 is a top view of one modification of the boundary means in which the latter is constituted in part by a grate and in part by a masking sheet metal.

As shown in FIGS. 1 and 2 the ejector means 17 for ejecting all elements from a respective, not completely filled, counting bar 2 is arranged between the upper and the lower run of the unit 1 adjacent to the upper run 14. The ejector means 17 preferably comprise a comb-like ejector bar 36, as shown in FIGS. 2 and 9, which is actuated electromagnetically or pneumatically in a manner known in the art from a signal produced by the scanning means 16. A removable receiving container 37 is arranged above the upper run 14, in the region of the ejector means 17, for receiving the elements 21 ejected by the ejector means.

Instead of the scanning device 16 and the ejector means 17 it is also possible to provide a combined control and additional filling means 38 as shown in FIG. 7.

Such a combined control and additional filling means 38 may also be located upstream of the scanning means 16.

As shown in detail in FIG. 7, the combined control and additional filling means 38 comprises mainly a magazine 39 for the elements 21, a plurality of push rods 40, one for each cutout 22 in a counting bar and each adapted to cooperate with the lowermost elements 21 in the upright magazine 39 and scanning or sensing element 41 for each push rod for sensing the presence or absence of an element 21 in the respective cutout of the counting bar. The sensing elements 41 are tiltable about an axis, so that if the lower portion of a respective sensing element 41 moves into a cutout in which no element is located, a compression spring 42, acting on the rear end of the respective push rod 40 expands suddenly, so that the push rod moves forwardly to push the lowermost element 21 into a discharge channel 43, corresponding to the respective cutout, from where it falls into the empty cutout of the counting bar. A set screw 44 acting on the end of the compression spring, opposite from the push rod 40, serves to adjust the pretension of the compression spring 42.

In order to prevent the elements from falling out in outward direction from the cutouts in the counting bars 2 in the region of the front reversing means 4, there is provided in this region a hood 45, preferably of transparent material, which is releasably connected to a support 46, as best shown in FIGS. 1 and 2. Downstream of this reversing region there is provided, between the upper run 14 and the lower run 13, in the region of the latter, a device for pushing out any elements which are clamped in the respective cutouts. This push-out device is constituted by a push out roll 48 which has radially extending projections 47, arranged to penetrate into the cutouts 22 of the counting bars 2, during movement of the latter passed the push out roll 48. The push-out device can also be differently formed, for instance by a magnetically or pneumatically operated push-out comb, the teeth of which are adapted to enter from the inside into the cutouts 22 of the counting bars.

Figure 12:
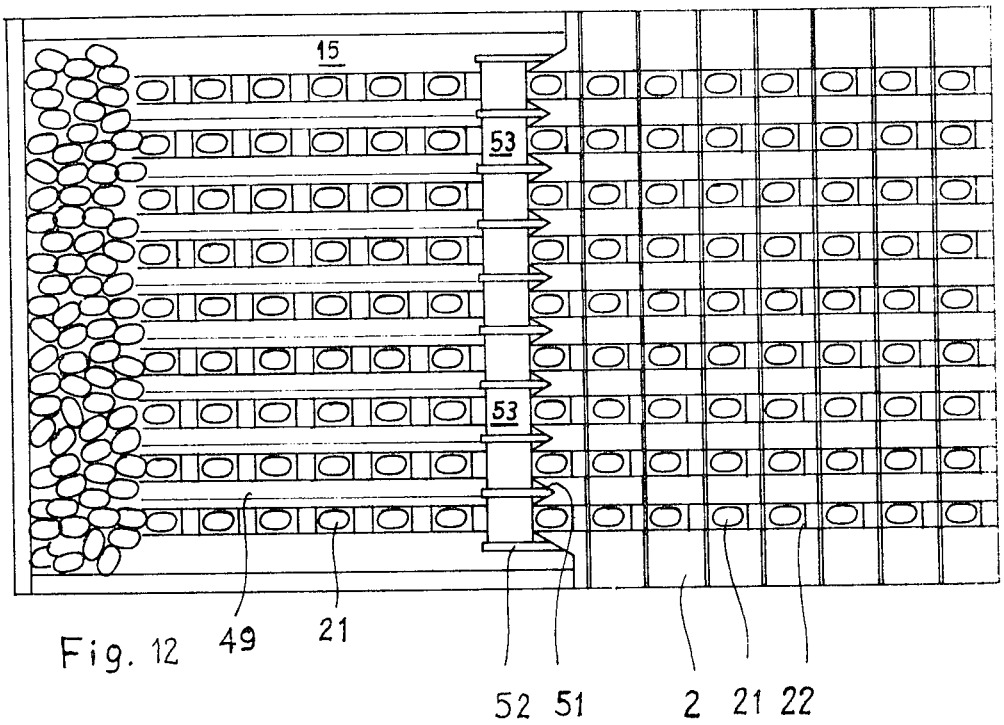
FIG. 12 is a top view of part of the apparatus.

As shown in FIGS. 1, 3 and 12, a forming grate 15 is provided at the side of the machine at which the elements are filled in the cutouts. The forming grate 15 is located directly above the upper run 14 of the unit 1 and below the feed channel 18. The forming grate 15 comprises a plurality of longitudinally extending bars 49, extending substantially normal to the counting bars 2, and having upper faces which are laterally inclined, whereby the forming process, including the sliding of the elements 21 into the spaces between the longitudinal bars 49 is facilitated. The ends 59 of the bars 40, which face the scanning means 16, are provided with upwardly projecting lamellae 52. The bars 49 are separated from each other by spacing members 53 arranged in the region of the lamellae 52. It is essential that the forming grate is open at its upper end for the passage of eventually excess elements so that breaking of the elements is avoided. Therefore, the spacing elements 53 are located between upper portions of lamellae 52. The ends 51 of the bars 49 of the forming grate 15, directed toward the scanning means 16, may also be wedge shaped, as shown in FIG. 12. The width of the cutouts 22 in the counting bars 2 is slightly greater than the respective distance between the longitudinal bars 49 of the forming grate. This will assure that the elements 21 will pass substantially without friction into the cutouts 22 of the counting bars 2. The forming grate 15 is adjustable in vertical direction relative to the counting bars 2 and may be vibrated by means of a vibrator or a motor. The longitudinal bars 49 of the forming grate 15 may be constructed of elastic material or at least covered with such a material. This will assure a proper protection of the elements 21. The longitudinal bars 49 of the forming grate are preferably constructed in such a manner that they taper conically in longitudinal direction toward the scanning means 16. By the provision of the forming grate 15, the operating safety of the apparatus is considerably increased and a uniform charging of the counting bars 2 with elements 21 is assured, whereby an increase of the output of the apparatus is obtained.

The receiving and transporting unit 1 is tiltable about the shaft 6 of the front reversing means 4 and the rear reversing means 5 together with the feed channel 18 and the hopper 19 are movable up and down in vertical direction relative to the shaft 6 of the front reversing means 4, which is arranged at a fixed level on the frame of the apparatus, to thereby change the inclination of the unit 1. For this purpose a roll 55, mounted in the region of the rear reversing means 5 on the support 46, engages an elevating platform 57, which may be lifted or lowered by a spindle drive 56 operable by a crank 71, or any other means known in the art, for instance by hydraulically operated cylinder-and-piston means. During lifting or lowering of the elevating platform 57, the feed channel 18 and the hopper 19 are also moved in the same vertical direction since the feed channel 18 and the hopper 19 are mounted on a platform 73, which is connected by vertical columns 72 to the elevating platform 57. This arrangement has the advantage that the counting and filling apparatus may be adapted in a simple manner to different sizes or forms of the elements to be counted and filled into the apparatus, so that an optimum output is obtainable in every case. In order to facilitate maintenance or change-over of the apparatus, the unit 1 is releasably connected to the machine frame. In addition, the rear reversing means 5 is provided with a device for keeping the unit 1 under tension. This device consists essentially of two parallel screw spindles 58, only the front one is shown in FIGS. 1 and 2, which engage the shaft 7 of the rear reversing means 5 and which are movable in longitudinal direction by nuts 59 screwed onto the spindles 58 and abutting against the support 46 on which the front and rear reversing means 4 and 5 are mounted. As shown in FIG. 1, the shaft 7 of the rear reversing means 5 is guided in longitudinal slots provided in the support and extending in axial direction of the screw spindles 58.

Figure 5:
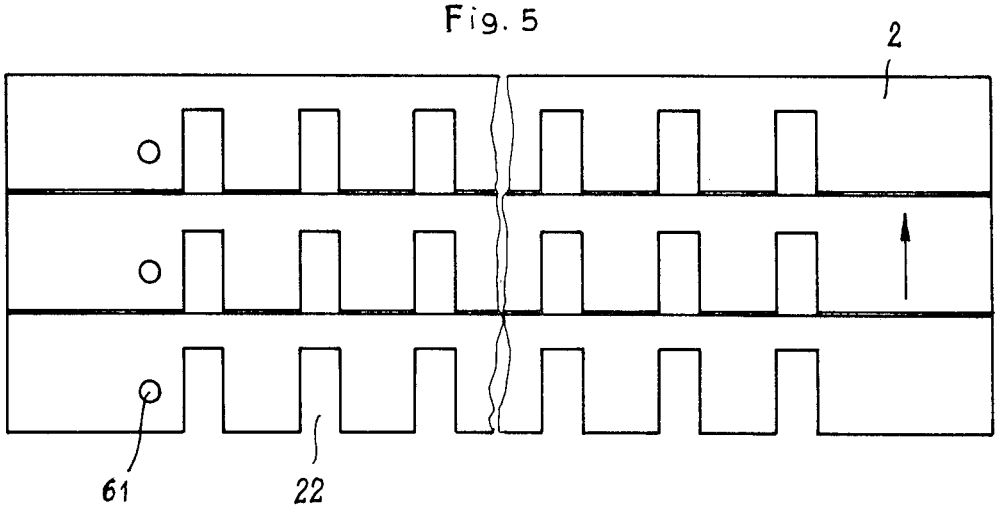
Figure 6:
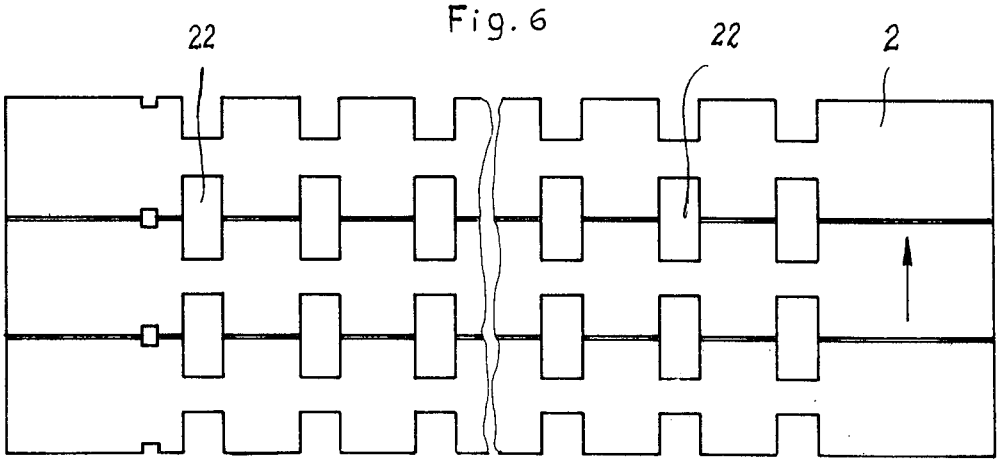

The cutouts 22 in the counting bars 2 for receiving the elements 21 may be arranged in various different manners. Thus, as shown in FIG. 4, the cutouts 22 may be arranged centrally in the counting bars 2, or as shown in FIG. 5, the cutouts 22 may extend into the counting bars 2 from the front face of the individual counting bars, or, as shown in FIG. 6, halves of each cutout 22 may extend from adjacent front faces of adjacent counting bars 2 into the latter.

Figure 8:
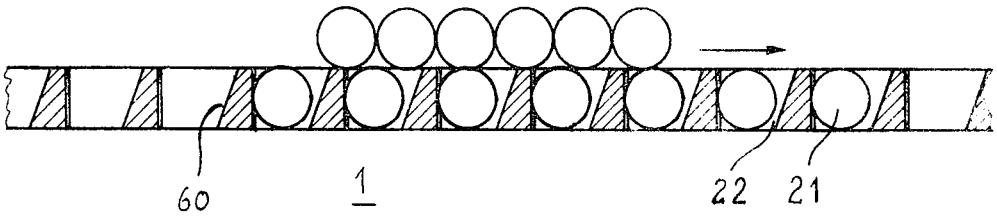
FIG. 8 is a transverse cross-section through a plurality of counting bars.

In order to facilitate sliding of the elements 21 into the cutouts 22 provided in the counting bars 2, it has been proven advantageous if, as shown in FIG. 8, the surface 60 of each cutout 22, leading in the direction of movement of the counting bars, is downwardly inclined toward the surface opposite the surface 60.

In order to count the counting bars 2 and therewith the number of elements filled thereinto per operating cycle and in order to control the scanning device 16, the ejecting device 17 and/or the additional filling station 38, the counting bars are provided in the region of at least one of the ends thereof with markings, which are respectively arranged substantially aligned with the centers of the cutouts 22 formed therein in the respective bar. Electro-optical scanning means or similar element are coordinated with these markings provided on the counting bars 2. As shown in FIG. 4, the markings are constituted by bores 61, extending through the counting bars, with which at least one electro-optical scanning device 62, of known construction co-operates. Instead of bores the markings on the counting bars may also be constituted by small reflectors. The counting bars 2 may also be rounded at the upper faces thereof.

The above-described counting and filling apparatus will operate as follows:

The elements 21 to be filled into the counting and filling apparatus pass from the hopper 19 first onto the vibrated feed channel 18 and from the latter onto the forming grate 15 which may be likewise vibrated. The duration at which the feed channel 18 is vibrated is controlled by electro-optical scanning means 63 which checks the height of a staple of filling elements 21 forming at the left end of the forming grate 15, as viewed in FIG. 1, to stop further vibration when the staple reaches the elevation of the scanning means 63. The size of the outlet opening of the hopper 19 through which the element 21 leaves the latter may be adapted to the respective conditions, respectively to the respective dimensions of the elements 21 by the slide plate 20.

The elements 21 pass from the forming grate 15 into the cutouts 22 of the counting bars 2 to be taken along by the latter and transported to the discharge station 67. The loading of the counting bars 2 with elements 21 occurs thereby quicker and with less friction than could be obtained without the use of a forming grate.

The boundary means in form of the grate 24, which, if necessary, may also be oscillated, and which extend directly below the upper run 14, prevents, in combination with the following masking sheet metal 27 which extends into the region of the front reversing means 4, dropping of the elements 21 out of the cutouts 22. Element particles, dust, or similar foreign bodies will fall through the intersticies between the bars of the grate 24 downwardly into the chamber 34, from which they may be sucked, by a suction device connected to the outlet opening 34 of the chamber, out of the latter.

The individual counting bars 2 are counted by the electro-optical device 62 shown in FIG. 4*a*. The signal produced by the device 62 during passage of the counting bars 2 therebeneath actuates in timed sequence the scanning device 16, under consideration of the time passing from the actuation of the signal until the respective counting bar reaches the scanning device 16. If one or a plurality of elements are missing in the respective cutouts of one counting bar the corresponding L-shaped lever or levers 65 of the scanning device tilt downwardly about the axis 64 into the respective empty cutout 22 or cutouts of the respective counting bar. Thereby a light ray normally passing through an opening in a vane projecting upwardly from the free end of each lever 65 from the fork-shaped electro-optical device, coordinated with the respective lever, is interrupted to produce a signal. The signal thus produced actuates the ejecting device 36 at the moment in which the respective counting bar 2 reaches the ejecting device 17. The comb-shaped ejector bar pushes then all of the elements 21 in the cutouts 22 of the respective counting bar out of the latter and into the container 37. In this case the counting device for the bars will not be actuated.

The counting bars pass then over the reversing means 4 to the discharge station 67 which comprises a plurality of guide channels 68. The elements 21 normally fall due to their own weight into the channels 68 and pass from there into receiving containers 69 placed on a transporting band 70 or similar transporting arrangement.

Elements, which due to wedging do not drop out from the respective cutouts 22, are pushed by the push out roll 48 into the respective channels 68.

If it is advantageous or necessary that the angle of inclination of the unit 1 be changed, then it is only necessary to turn the crank 71 of the spindle drive 56. According to the direction of rotation of the crank 71, the unit 1 is tilted about the axis of the shaft 6 of the front reversing means 4 in one or the other direction and at the same time the hopper 19 and the feed channel 18 are lifted or lowered.

In order, for intance during counting of elements of small dimensions, to avoid settling of surplus elements in the spaces of cutouts which are formed for the reception of larger elements, the unit 1 may be adjusted to a steep angle of inclination so that such surplus elements, due to their own weight will not remain in such recesses of the cutouts.

In order to arrange the elements 21 properly, the individual counting bars 2 may also be provided with forming barriers 74 to opposite sides of the cuouts 22 therein. In this case a separate forming grate 15 may become unnecessary. In this case the cover or hood 45 extending about the front reversing means 4 has to be provided with necessary slots in order that the barriers 74 may pass through the hood 45.

Instead of providing separate boundary means, as described above, to prevent falling of the elements 21 out of the cutouts 22 during the passage of the counting bars along the upper run 14, the cutouts 22 may have at the lower ends open cross-sections smaller than the minimum dimension of the elements, but of course the smaller dimensioned lower ends of the cutouts have to be large enough to permit passage of the projections of the ejector device 17 therethrough.

If a perforated band is used as boundary means for the elements 21, it is advantageous to arrange the suction device directly below this band in the region between the upper and the lower run 14 and 13.

Figure 16:
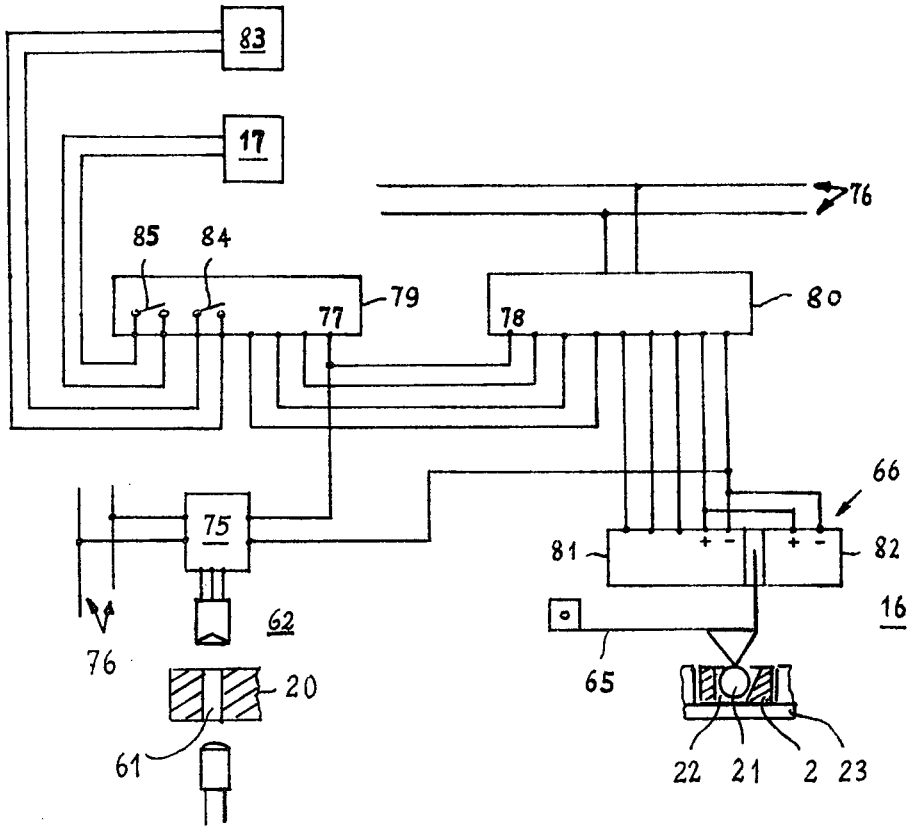
FIG. 16 is a wiring diagram for the apparatus.

FIG. 16 schematically illustrates a wiring diagram of the apparatus. As shown in FIG. 16, a storage unit 75 connected to the network 76 is connected to the receiver of the electro-optical device 62 and the unit 75 is connected to the contact 77, 78 of an amplifier 79 and a net part 80, as well as to the poles of the receiver 81 and the transmitter 82 of the fork-shaped electro-optical device 66 of the scanning means 16 which is likewise connected to the net part 80.

83 is a counter, whereas the ejector device 17 is schematically illustrated as a square in FIG. 16. If all cutouts 22 of the counting bars 2 are filled with elements 22, then the counting relay 84 closes and the counter 83 is actuated. If one or a plurality of elements are missing in the respective cutouts, then the scanning device 17 is operated in the manner mentioned above so that a signal is produced by the fork-shaped electro-optical device 66 which prevents closing of the counting contact 84 and which actuates the relay 85. This in turn will actuate the ejector device 17 in the manner as described above.

As mentioned above additional filling means may be provided instead of the injector means. While the additional filling means shown in FIG. 7 are provided with mechanical scanning means, it is to be understood that electro-optical scanning means, as shown at 16 in FIG. 1, may also be used for the additional filling means, in which case the push rods 40 thereof may be operated by solenoids, controlled by signals produced by the scanning means 16.

It will be understood that each of the elements described above, or two or more together, may also find a useful application in other types of counting and filling apparatus differing from the types described above.

While the invention has been illustrated and described as embodied in a counting and filling apparatus for tablets, dragees or similar elements, it is not intended to be limited to the details shown since various modifications and structural changes may be made without departing in any way from the spirit of the present invention Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A counting and filling apparatus for tablets, dragees or similar elements, comprising, in combination, a plurality of elongated counting bars having longitudinal side faces and being each provided with cutouts spaced from each other in the longitudinal direction of each bar and each extending transversely through the respective bar; carrier elements carrying said bars substantially normal to said carrier elements with the side faces of the bars closely adjacent and parallel to each other and forming with said bars an endless receiving and transporting unit; front and rear reversing means over which said endless unit is guided to form between said reversing means substantially planar upper and lower runs; means to move said unit in an endless path about said reversing means; means for filling said cutouts in said bars during movement of the latter along said upper run with said element; scanning means at said upper run downstream of said filling means for scanning the presence or absence of elements in each of said cutouts of each counting bar; means downstream of said scanning means and controlled by the latter and cooperating with those bars in which said scanning means senses the absence of an element in at least one cutout of the respective bar; and boundary means directly below said counting bars travelling along said upper run for preventing elements in said cutouts to fall out of the latter.

2. A counting and filling apparatus as defined in claim 1, wherein said means controlled by said scanning means is constituted by ejector means for ejecting all elements from the respective bars if the scanning means scans the absence of an element from at least one cutout in the respective bar.

3. A counting and filling apparatus as defined in claim 1, wherein said means controlled by said scanning means is constituted by additional filling means downstream of said scanning means for filling the cutouts in the respective bars which has been sensed as being empty by said scanning means.

4. A counting and filling apparatus as defined in claim 2, wherein said boundary means are provided with openings for the passage of said ejector means therethrough.

5. A counting and filling apparatus as defined in claim 4, wherein said ejector means is arranged between said upper and said lower run of said receiving and transporting unit.

6. A counting and filling apparatus as defined in claim 1, wherein said filling means comprises a hopper for the elements having an opening through which the elements are discharged, a feed channel beneath said opening and having an outlet end, and a forming grate beneath said outlet end of the feed channel.

7. A counting and filling apparatus as defined in claim 1, and including a hood extending about said front reversing means, and support means to which said hood is releasably attached.

8. A counting and filling apparatus as defined in claim 7, and including push-out means downstream of said hood for pushing out all elements from the cutouts in said bars.

9. A counting and filling apparatus as defined in claim 8, wherein said push-out means comprise a roller having a plurality of projections spaced in the direction of the roller axis equal to the spacing of said cutouts in said bars and adapted to penetrate from the inner ends of said cutouts into the latter during movement of said counting bars along the lower run.

10. A counting and filling apparatus as defined in claim 8, wherein said push-out means comprise an elongated push-out comb having a plurality of projections spaced in the direction of elongation of the comb equal to the spacing of the cutout in the bars, and means for pushing said projections from the inner ends of the cutouts into the latter as the bars move along the lower run.

11. A counting and filling apparatus as defined in claim 1, wherein said boundary means are constituted at least in part by a grate.

12. A counting and filling apparatus as defined in claim 1, wherein said boundary means comprise a grate and a masking sheet metal following said grate in the direction of movement of said bars along said path.

13. A counting and filling apparatus as defined in claim 11, wherein said grate comprises a plurality of lamellae extending normal to the counting bars respectively aligned with the cutouts formed therethrough and having upper faces smaller than the width of said cutouts.

14. A counting and filling apparatus as defined in claim 11, wherein said grate comprises a plate formed with elongated slots extending normal to said bars.

15. A counting and filling apparatus as defined in claim 11, wherein said grate comprises a profiled body having longitudinal ribs extending normal to said bars and spaced in transverse direction from each other and respectively aligned with said cutouts in said bars.

16. A counting and filling apparatus as defined in claim 1, wherein said boundary means comprise a band arranged for movement with said unit.

17. A counting and filling apparatus as defined in claim 16, wherein said band is perforated.

18. A counting and filling apparatus as defined in claim 1, and including a chamber coordinated with said boundary means and having an outlet for connection of suction means thereto.

19. A counting and filling apparatus as defined in claim 1, wherein said front and rear reversing means are rotatable about axes extending parallel to the longitudinal direction of said bars, and wherein said means for moving said unit along said endless path comprises motor means connected to at least one of said reversing means for rotating the same about its axis.

20. A counting and filling apparatus as defined in claim 19, wherein said front reversing means is rotatable about a fixed axis and including means connected to said rear reversing means for moving the axis thereof away from that of said first reversing means for stretching said unit.

21. A counting and filling apparatus as defined in claim 20, wherein said unit is tiltable about the axis of said front reversing means.

22. A counting and filling apparatus as defined in claim 1, and including support means, said front and rear reversing means together with said unit being mounted on said support means removable therefrom.

23. A counting and filling apparatus as defined in claim 20, and including means for moving said rear reversing means together with said filling means in vertical direction to thereby tilt and unit about the axis of said front reversing means.

24. A counting and filling apparatus as defined in claim 23, wherein said means for moving said rear reversing means and said filling means in vertical direction comprises a platform connected to said filling means and to said unit in the region of the rear reversing means, and means for raising and lowering said platform.

25. A counting and filling apparatus as defined in claim 24, wherein said means for raising and lowering said platform comprises a spindle drive.

26. A counting and filling apparatus as defined in claim 1, wherein said carrier elements comprise transporting chains and wherein said front and rear reversing means comprise sprocket wheels engaging said chains.

27. A counting and filling apparatus as defined in claim 1, wherein said carrier elements comprise transporting chains and wherein said boundary means in the region of the front reversing means comprise a semi-cylindrical inner casing.

28. A counting and filling apparatus as defined in claim 1, wherein said carrier elements are constituted by endless bands, each of which may be severed and reconnected and wherein said boundary means in the region of said front reversing means comprises a semi-circular inner casing.

29. A counting and filling apparatus as defined in claim 2, wherein said ejector means comprise a comb-like bar and means for moving said comb-like bar towards and away from said counting bars.

30. A counting and filling apparatus as defined in claim 29, and including a detachable receiving container adjacent said ejector means for receiving the elements ejected by said ejector means.

31. A counting and filling apparatus as defined in claim 2, and including additional filling means and additional scanning means controlling said additional filling means for filling the cutouts which have been sensed as being empty by said additional scanning means, said additional filling means being arranged upstream of the scanning means for said ejector means.

32. A counting and filling apparatus as defined in claim 31, wherein said filling means include a forming grate, and including support means to which said forming grate, said scanning means, said ejector means and said additional filling means are releasably mounted.

33. A counting and filling apparatus as defined in claim 6, wherein said boundary means includes a grate and including means for vibrating at least one fo said grates.

34. A counting and filling apparatus as defined in claim 1, wherein said scanning means include a mechanical scanning element.

35. A counting and filling apparatus as defined in claim 1, wherein said scanning means is constituted by an electro-optical device.

36. A counting and filling apparatus as defined in claim 6, wherein said forming grate comrpises a plurality of transversely spaced bars extending substantially normal to said counting bars and having upper faces which are laterally inclined.

37. A counting and filling apparatus as defined in claim 36, wherein said bars of said forming grates have ends facing said scanning means, said ends being wedge-shaped.

38. A counting and filling apparatus as defined in claim 36, wherein said bars of said forming grate are provided in the region of said ends with lamellae.

39. A counting and filling apparatus as defined in claim 38, and including spacing members in the region of said lamellae for spacing said bars of said forming grate in transverse direction from each other in such a manner that the free space between adjacent bars of said forming grate is smaller than the width of said cutouts in said counting bars.

40. A counting and filling apparatus as defined in claim 36, wherein said forming grate is adjustable toward and away from said counting bars.

41. A counting and filling apparatus as defined in claim 36, wherein said bars of said forming grate consist of elastic material.

42. A counting and filling apparatus as defined in claim 36, wherein said bars of said forming grate are covered with elastic material.

43. A counting and filling apparatus as defined in claim 36, wherein said bars of said forming grate taper in direction towards said scanning means.

44. A counting and filling apparatus as defined in claim 1, wherein said cutouts in each counting bar are provided in the latter symmetrically with respect to the longitudinal plane of symmetry of each bar.

45. A counting and filling apparatus as defined in claim 1, wherein said cutouts in each counting bar extend from one side face of the bar into the latter.

46. A counting and filling apparatus as defined in claim 1, wherein one half of each cutout for receiving said elements extends from one side face of one bar into the latter and the other half extends from the adjacent side face of the adjacent bar into said adjacent bar.

47. A counting and filling apparatus as defined in claim 1, wherein each cutout in said counting bar has a face leading in the direction of movement of the unit which is downwardly inclined toward the opposite face of the respective cutout.

48. A counting and filling apparatus as defined in claim 1, wherein each of said counting bars has a marking at least in the region of one of the ends thereof and including sensing means cooperating with said marking on each bar.

49. A counting and filling apparatus as defined in claim 48, wherein said markings are consituted by openings through said counting bars and wherein said sensing means comprises an electro-optical device.

50. A counting and filling apparatus as defined in claim 1, wherein said counting bars have upper rounded faces.

51. A counting and filling apparatus as defined in claim 1, wherein said counting bars are provided with barriers projecting substantially normal to the elongation of said bars upwardly therefrom and arranged to opposite sides of the cutouts through said counting bars.

* * * * *